US007165788B2

(12) United States Patent
Smith et al.

(10) Patent No.: US 7,165,788 B2
(45) Date of Patent: Jan. 23, 2007

(54) BINDING WRAPPER

(76) Inventors: Christopher M. Smith, 318 Kentucky St., Petaluma, CA (US) 94952; Phillip H. Neal, 171 Terrace Ave., San Rafael, CA (US) 94901; Thomas J. Africa, 396 Locust Forge La., Lebanon, OH (US) 45036; Kate O'Hara, 876 S. Cassingham Rd., Bexley, OH (US) 43209

( * ) Notice: Subject to any disclaimer, the term of this patent is extended or adjusted under 35 U.S.C. 154(b) by 461 days.

(21) Appl. No.: 10/455,923

(22) Filed: Jun. 6, 2003

(65) Prior Publication Data

US 2004/0247374 A1 Dec. 9, 2004

(51) Int. Cl.
*B42D 3/00* (2006.01)

(52) U.S. Cl. ..... 281/45; 281/15.1; 402/73

(58) Field of Classification Search ..... 402/2, 402/73, 78; 281/15.1, 19.1, 19.2, 20, 28–29, 281/31, 34–35, 45–47
See application file for complete search history.

(56) References Cited

U.S. PATENT DOCUMENTS

| | | | | |
|---|---|---|---|---|
| 665,256 | A | 1/1901 | McComb | |
| 734,934 | A | 7/1903 | Palmer | |
| 738,462 | A | 9/1903 | Lincoln | |
| 781,948 | A * | 2/1905 | Hegele | 281/19.1 |
| 1,082,017 | A | 12/1913 | Feinen | |
| 1,492,677 | A * | 5/1924 | Dunbar et al. | 150/106 |
| 3,000,384 | A | 9/1961 | Piers, Jr. | |
| 3,086,529 | A | 4/1963 | Munz et al. | |
| 3,142,495 | A * | 7/1964 | Lu | 281/29 |
| 3,372,438 | A | 3/1968 | Rinecker | |
| 3,376,865 | A | 4/1968 | Gamper | |
| 3,683,987 | A * | 8/1972 | Robertson | 383/99 |
| 3,743,084 | A * | 7/1973 | Douglas | 206/532 |
| 3,947,927 | A | 4/1976 | Rosenthal | |
| 4,417,710 | A | 11/1983 | Adair | |
| 4,627,223 | A * | 12/1986 | Janhonen | 53/449 |
| 4,684,559 | A | 8/1987 | Wasko | |
| 4,700,432 | A | 10/1987 | Fennell | |
| 4,712,766 | A | 12/1987 | Ehrenhalt | |
| 4,961,596 | A * | 10/1990 | Moor | 281/15.1 |
| 5,086,543 | A | 2/1992 | Mitchell | |
| 5,366,248 | A * | 11/1994 | Donvan et al. | 281/46 |
| 5,378,022 | A | 1/1995 | French et al. | |
| 5,474,332 | A * | 12/1995 | Yeh | 281/19.1 |
| 5,477,965 | A * | 12/1995 | Herbeck | 206/424 |
| 5,494,366 | A * | 2/1996 | Pell et al. | 402/73 |
| 5,590,781 | A * | 1/1997 | Shackelford et al. | 206/521 |
| 6,030,140 | A * | 2/2000 | Karten et al. | 402/73 |
| 6,059,478 | A * | 5/2000 | Moor | 402/73 |

(Continued)

FOREIGN PATENT DOCUMENTS

| | | |
|---|---|---|
| WO | WO 02/35959 A1 * | 5/2002 |

*Primary Examiner*—Monica Carter
*Assistant Examiner*—Eric A. Gates
(74) *Attorney, Agent, or Firm*—Thompson Hine LLP

(57) ABSTRACT

A binding wrapper including a first generally stiff end component, a second generally stiff end component spaced apart from the first end component, and a connecting component extending between the first and second end components. The connecting component includes at least a portion of elastic material, and the first and second end components are releasably attachable together such that the wrapper is formable into a closed loop.

24 Claims, 5 Drawing Sheets

U.S. PATENT DOCUMENTS 6,079,528 A * 6/2000 Moor ..... 190/126
6,241,414 B1 * 6/2001 Wien ..... 402/73
6,276,722 B1 * 8/2001 Moor ..... 281/29
6,739,784 B1 5/2004 Tims et al.
D498,257 S * 11/2004 Africa et al. ..... D19/27

* cited by examiner

BINDING WRAPPER

BACKGROUND

Students and other users often use backpacks, bags, and other storage devices to carry various loose materials, such as books, notebooks, school supplies, writing instruments, etc. However, backpacks and bags may not provide quick and convenient access to the stored contents. Furthermore, with increased security concerns at schools and other locations, use of backpacks, bags and other similar storage devices may be discouraged. Accordingly, there is a need for an improved device for storing loose materials.

SUMMARY

The present invention is a binding wrapper shaped to fit around or loop around loose materials to thereby grip the loose materials. The binding wrapper and loose materials can then be carried as a packaged stack of materials.

In one embodiment, the invention is a binding wrapper including a first generally stiff end component, a second generally stiff end component spaced apart from the first end component, and a connecting component extending between the first and second end components. The connecting component includes at least a portion of elastic material, and the first and second end components are releasably attachable together such that the wrapper is formable into a closed loop.

Other objects and advantages of the present invention will be apparent from the following description and the accompanying drawings.

DETAILED DESCRIPTION

Figure 1:
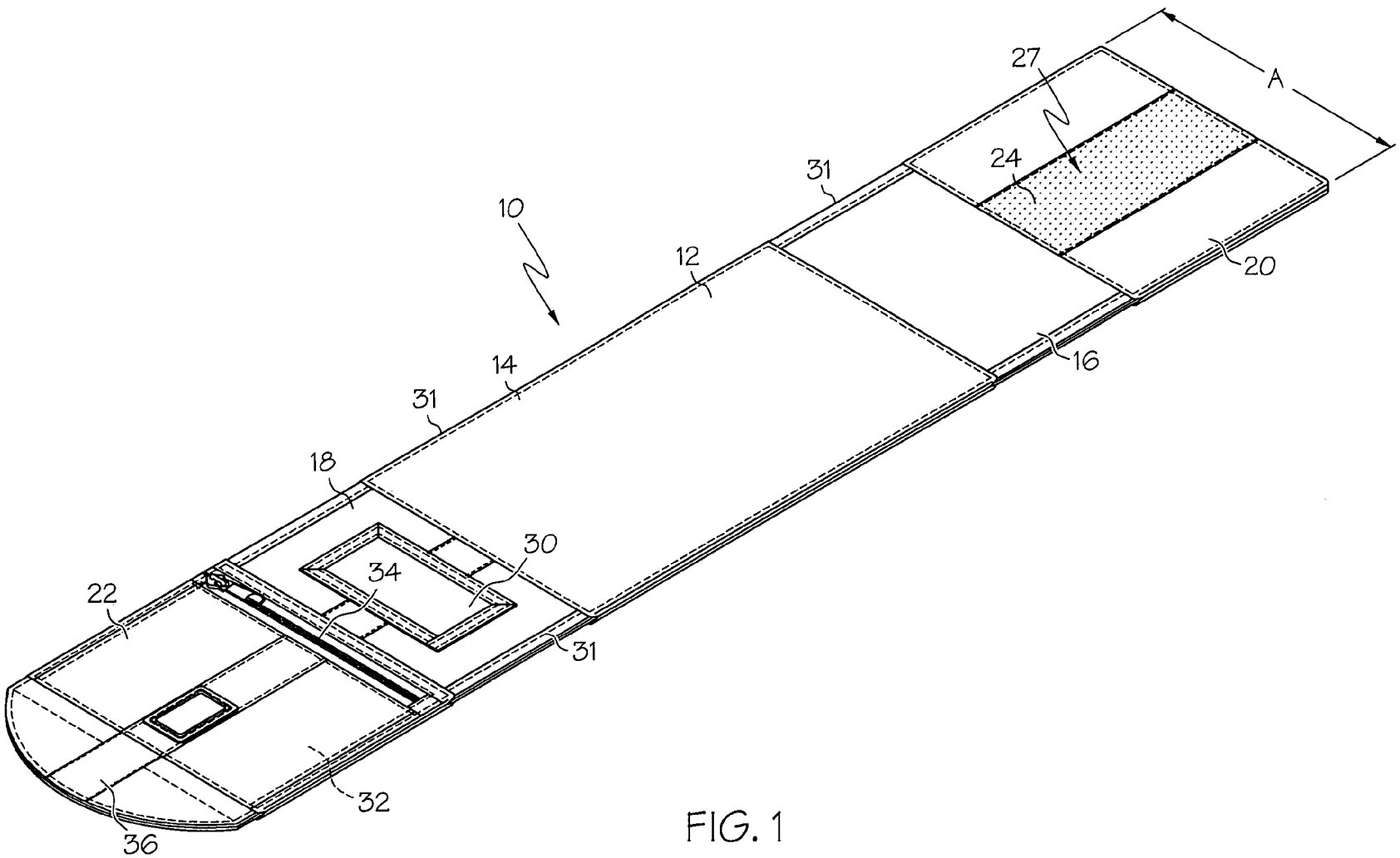
FIG. 1 is a front perspective view of one embodiment of the binding wrapper of the present invention, shown in its open (flat) position.
Figure 2:
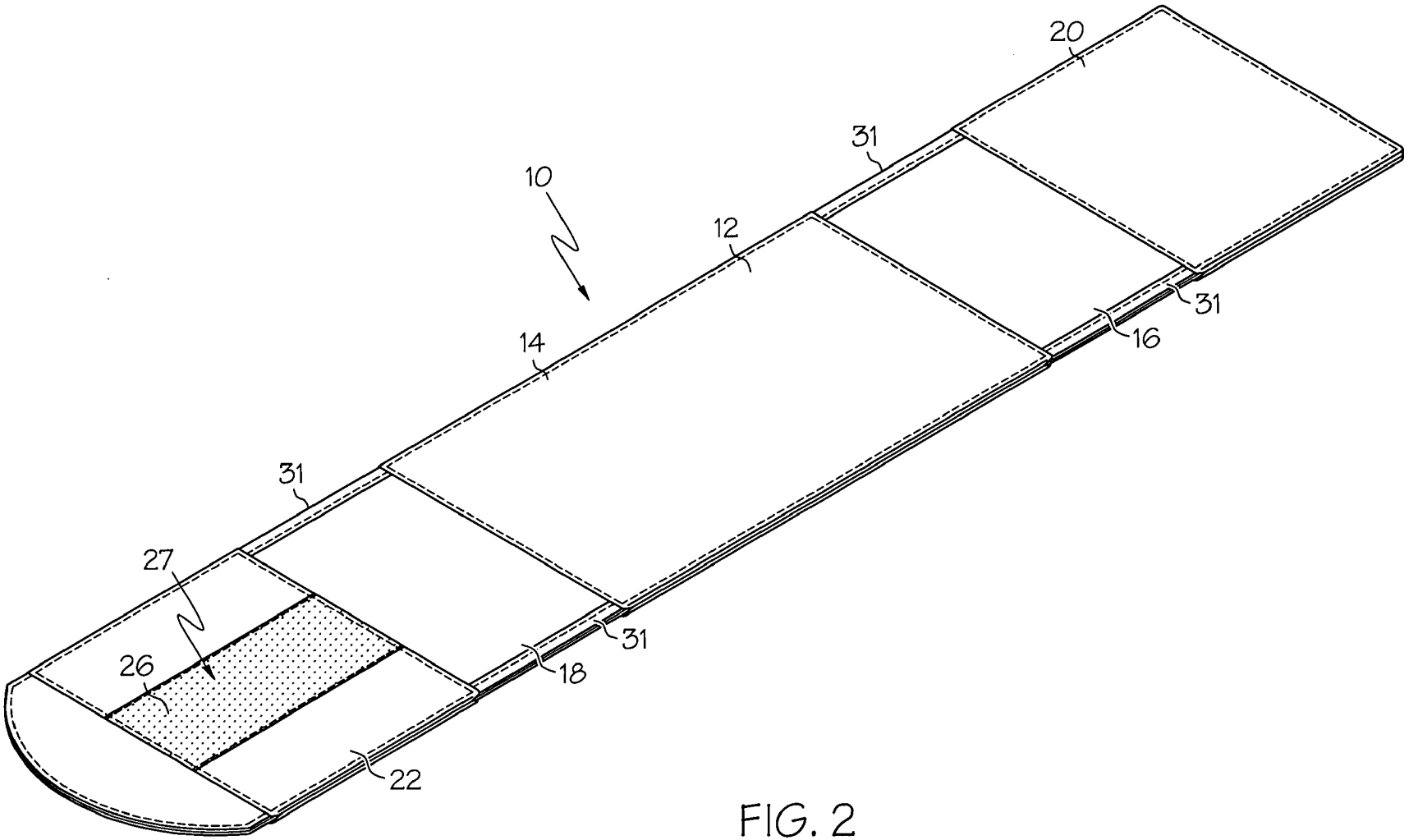
FIG. 2 is a back perspective view of the binding wrapper of FIG. 1.
Figure 3:
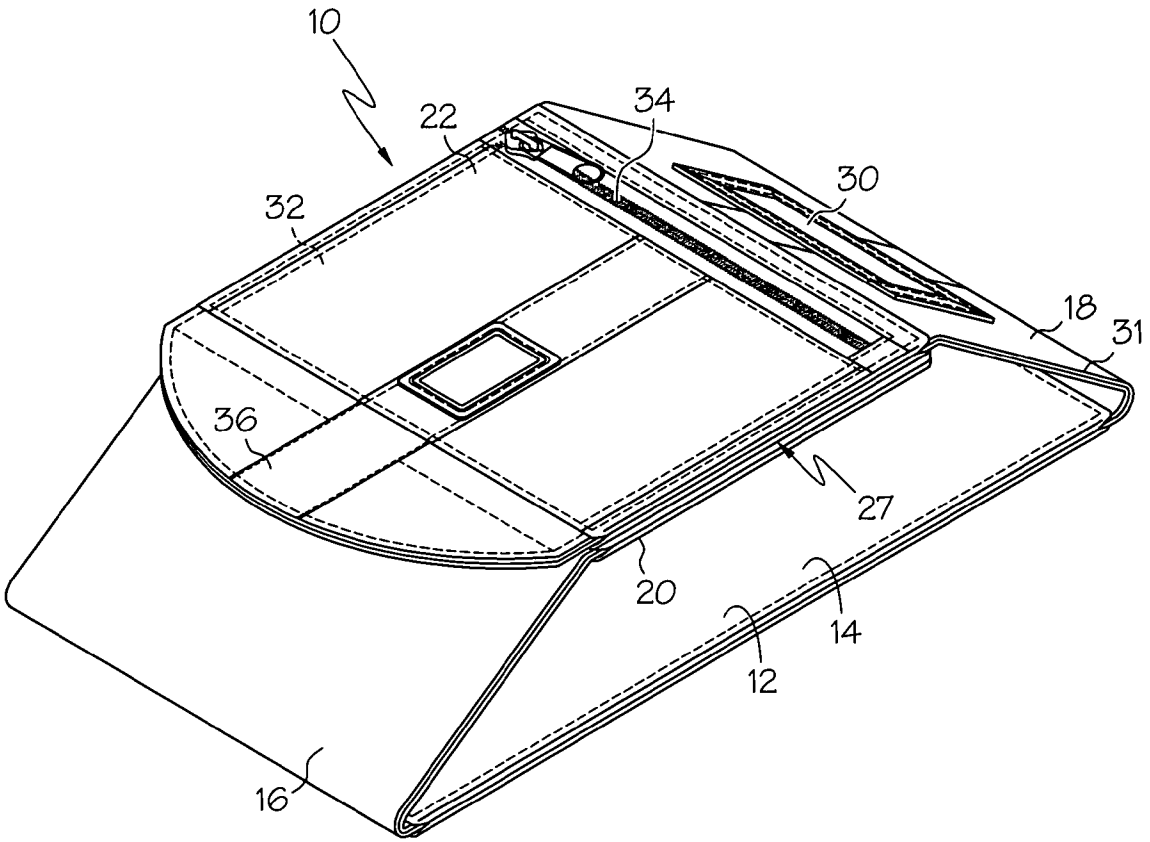
FIG. 3 is a front perspective view of the binding wrapper of FIG. 2, shown in its closed (looped) position.

As shown in FIGS. 1–3, in one embodiment the binding wrapper 10 may include a generally elongate or rectangular body 12. The binding wrapper 10 may include a backing component 14 generally centrally located in the body 12 of the binding wrapper 10. The binding wrapper 10 may include a first generally stretchable or elastic component 16 coupled to and extending from a first side of the backing component 14, and a second generally stretchable or elastic component 18 coupled to and extending from a second opposed side of the backing component 12. The binding wrapper 10 may also include a first end component 20 coupled to the first elastic component 16 and a second end component 22 coupled to the second elastic component 18. In one embodiment, the backing component 14 and elastic components 16, 18 may collectively be termed the "connecting component" which extends between and/or connects the end components 20, 22. Each of the elastic components

16, 18 may be generally elastic, flexible or pliable and may include a fabric covering 31 at its outer edges to protect the exposed edges.

Each of the backing 14 and end 20, 22 components (each of which may be generically designated a "support" component) may be generally stiff and generally planar. The backing component 14 and end components 20, 22 may be sufficiently stiff to support the weight of a typical stack of school supplies or other loose components (i.e., up to several pounds) while remaining generally planar. Alternately, the support components 14, 20, 22 may simply be stiffer than the elastic components 16, 18. Each of the backing 12 and end 20, 22 components, as well as the elastic components 16, 18, may include substantially identical widths such that the binding wrapper 10 is generally rectangular when laid flat (as shown in FIGS. 1 and 2). The binding wrapper 10 may have a width A greater than about 1 inch, further preferably greater than about 4 inches, and in one embodiment has a width of about 6 inches. Each of the end components 20, 22 and/or the backing component 14 may include a tactile or frictional gripping surface, such as a roughened rubber-like surface located on an inner surface thereof (that is, the surfaces of the components 20, 22, 14 visible in FIG. 2).

The binding wrapper 10 may include an attachment mechanism 27 for releasably coupling the ends of the binding wrapper 10 together, and/or for releasably coupling the end components 20, 22 together. For example, in the illustrated embodiment, the attachment mechanism 27 may include a first patch 24 of hook and loop fastening material (such as VELCRO®) located on an outer surface of the end component 20 (FIG. 1), and a corresponding, complementary patch 26 of hook and loop fastening material located on an inner surface of the end component 22 (See FIG. 2). In the illustrated embodiment, the patches of hook and loop fastening 24, 26 material extend along substantially the entire length of the corresponding end components 20, 22. Furthermore, a wide variety of attachment mechanisms, besides the hook and loop fastening system illustrated herein, may be used to couple the ends or end components 20, 22 together without departing from the scope of the present invention. For example, a wide variety of hooks, clasps, zippers, interengaging geometries, cords, ties, straps and the like may be used.

As shown in FIG. 3, the binding wrapper 10 may be moved from its open position (FIGS. 1 and 2) wherein the binding wrapper 10 is laid generally flat to its closed position (FIG. 3) wherein the ends of the binding wrapper 10 are attached together to form the binding wrapper 10 into a generally closed loop. For example, in the illustrated embodiment, in order to move the binding wrapper 10 from its open to its closed position, the binding wrapper 10 is laid flat in its open position and on its outer surface (FIG. 2). Each of the end components 20, 22 are then pivoted generally inwardly over the backing component 12 such that each end component 20, 22 overlaps with each other, or is located above the end component 14. The patch of hook and loop fastening material 26 of end component 22 may then be pressed into engagement with the corresponding patch of hook and loop fastening material 24 located on end component 20 to releasably couple the end components 20, 22 together.

As shown in FIGS. 1 and 3, the binding wrapper 10 may include a label pocket 30 having a clear window such that a tag which identifies the contents of the binding wrapper 10 may be inserted into the label pocket 30. In the illustrated embodiment, the label pocket 30 is located on the elastic component 18 although the label pocket 30 can be located on nearly surface of the binding wrapper 10 (preferably on an outer surface so that the label pocket 30 remains visible when the binding wrapper 10 is closed). Furthermore, as shown in FIGS. 2 and 3, the binding wrapper 10 may include a storage pocket 32 located thereon for storing loose materials, such as pens, pencils and the like. In the illustrated embodiment, the storage pocket 32 includes a zipper 34 or other closure mechanism for controlling access to the pocket 32. The pocket 32 is illustrated as being located on an outer surface of the end component 22, although the storage pocket 32 can be located on nearly any surface of the binding wrapper 10. Furthermore, various other storage components, such as pen/pencil storage loops 36 (FIG. 4) and the like may be located on the binding wrapper 10.

Figure 5:
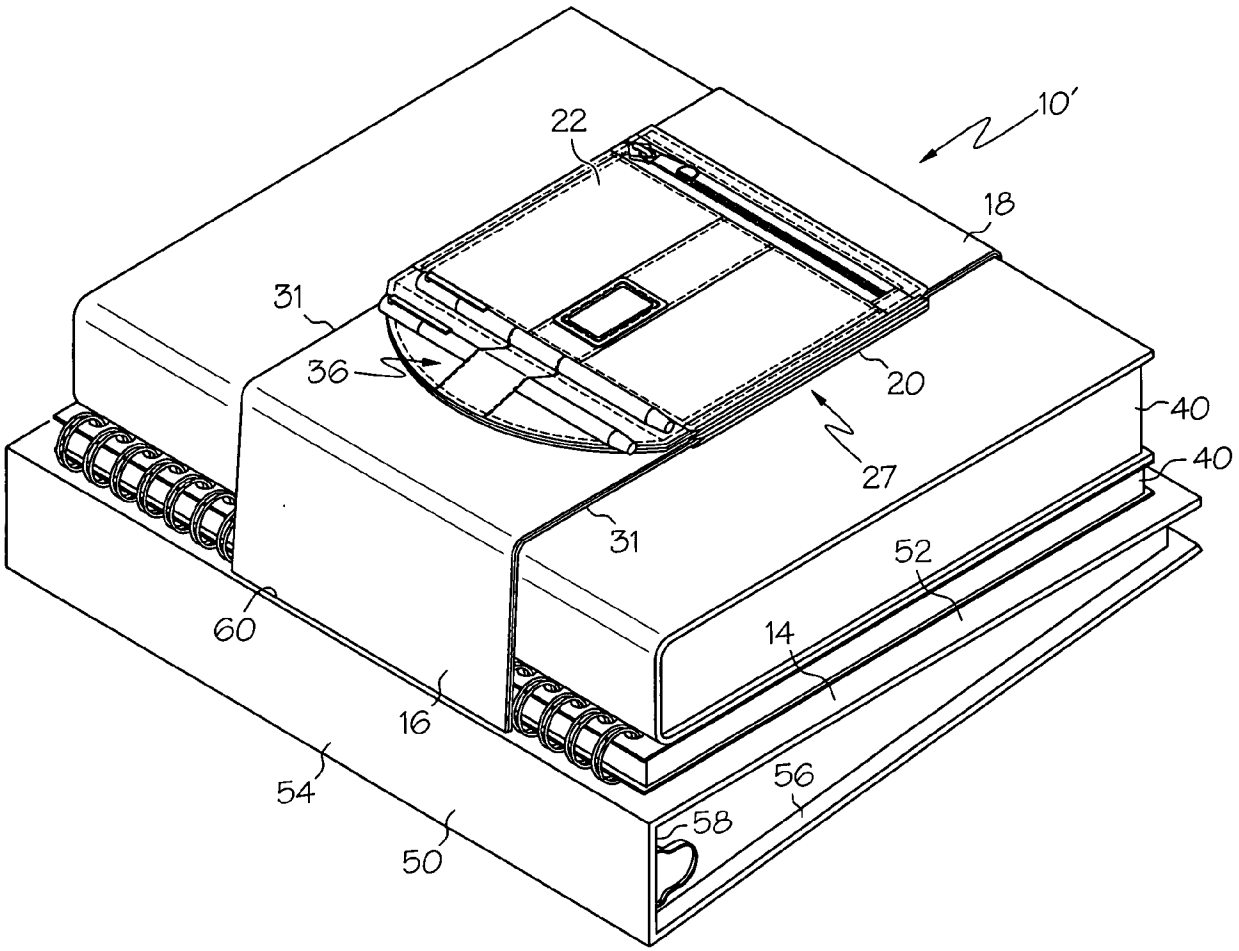
FIG. 5 is a front perspective view of another embodiment of the binding wrapper of the present invention.

As shown in FIG. 5, in another embodiment the binding wrapper (designated 10') may include or be part of a binder, generally designated 50. In particular, in the illustrated embodiment, the backing component 14 may include or be part of a cover 52 of the binder 50. The elastic component 16 may be coupled to the front cover 52 along connection line 60, and the elastic component 18 may be coupled to the front cover 52 along another similar connection line (not shown). The binder 50 may include a front cover 52, a spine 54 and a rear cover 56, and the front 52 and rear covers 56 may be pivotally coupled to the spine 54.

However, a portion or all of any of a wide variety of binders, portfolios, notebooks, folders and the like may also be used as part or all of any of the support panels 14, 20, 22. The binder 50 may include a binding mechanism, such as a three-ring binding mechanism, located on an inner surface of the binder 50, such as the inner surface 58 of the spine 54. In this embodiment, the binding wrapper 10' may include or be part of a binder 50 that can be used in conjunction with the loose materials stored by the binding wrapper. For example, the loose materials may also be able to be stored inside the binder 50.

Figure 4:
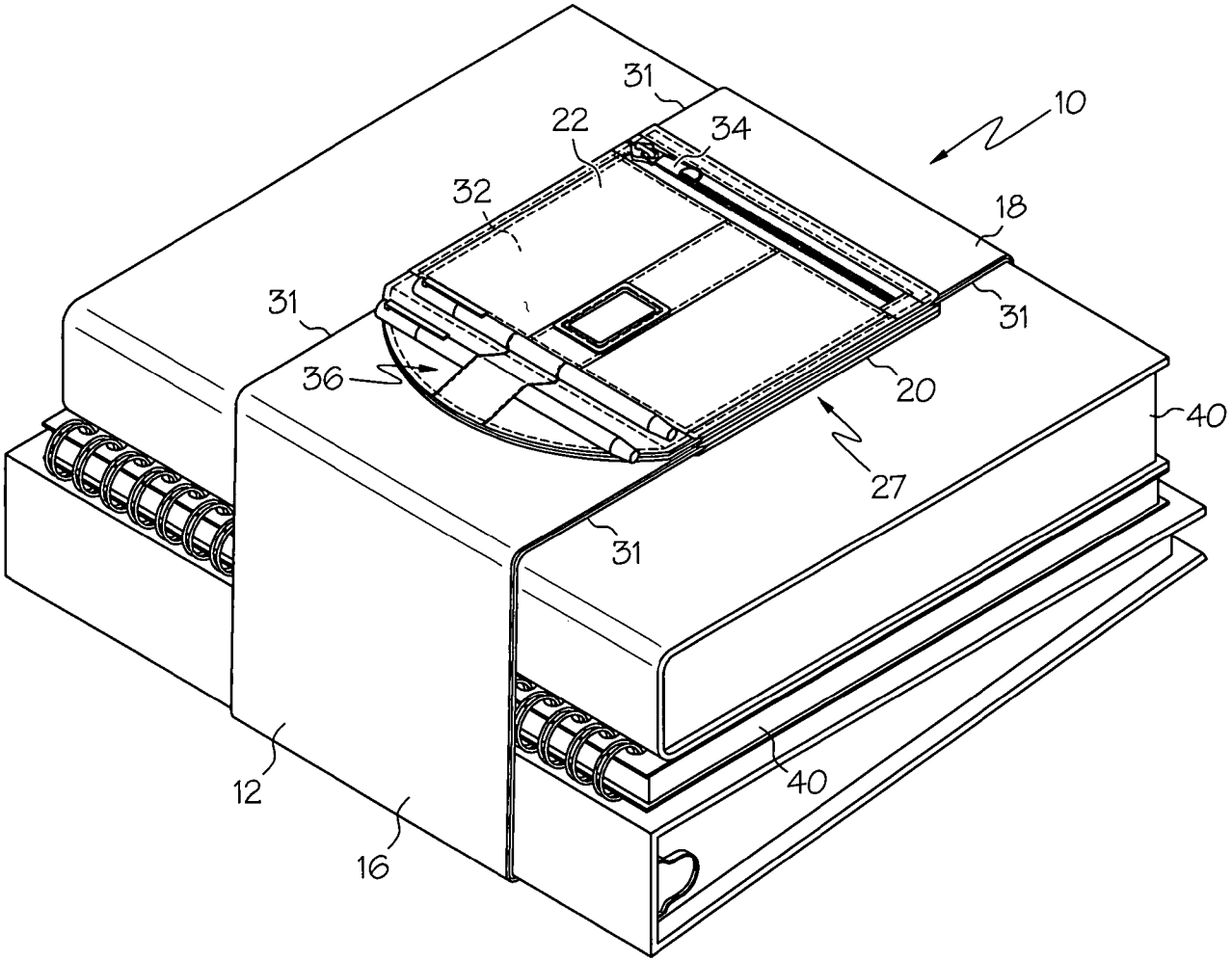
FIG. 4 is a front perspective view of the binding wrapper of FIG. 3 storing books therein.

As shown in FIG. 4, loose material or a plurality of loose materials 40 (such as, in the illustrated embodiment, various books and notebooks) may be able to be gripped by the binding wrapper 10. In order to grip the loose materials 40, the materials 40 may be located on the backing component 14 when the binding wrapper 10 is in its open position and laid on its outer surface. The end components 20, 22 may be tightly folded to their closed position around the loose materials 40. The end components 20, 22 may then be attached together by the attachment mechanism 24, 26 such that the loose materials 40 are tightly gripped in the binding wrapper 10. The elastic components 16, 18 of the binding wrapper 10 enable the binding wrapper 10 to expand to accommodate various sizes and/or volumes of loose materials. Furthermore, because the patches of hook and loop fastening material 24, 26 extend along substantially the entire length of the end components 20, 22, the end components 20, 22 can be coupled together in a wide variety of overlapping conditions (i.e., fully or partially overlapping) to allow the binding wrapper 10 to adapt and grip loose materials of various sizes.

The gripping surfaces located on the inner surfaces of the end 20, 22 and backing 14 components may frictionally grip the loose materials to help increase the frictional forces and aid the binding wrapper 10 in gripping the loose materials. Furthermore, besides allowing the binding wrapper 10 to expand to accommodate differently-sized loose components, the elastic components 16, 18 may be stretched or placed in tension when the binding wrapper 10 is moved to its closed position to grip loose materials. The stretching of the elastic materials 16, 18 causes the binding mechanism 10 to exert a force pressing the loose materials in compression between the end components 20, 22 and the backing component 14 to ensure that the loose components are tightly gripped inside the binding wrapper 10.

As noted earlier, the binding wrapper 10 may have a relatively significant width A to ensure that standard-sized school products, such as notebooks, binders and the like can be gripped and held in place by the binding wrapper 10. By providing an increased width A to the binding wrapper 10, the binding wrapper 10 has increased surface area and areas of contact with the materials to be gripped. Thus, an increased width A of the binding wrapper 10 helps to ensure secure gripping of the loose materials 40, and in particular may aid in preventing loose materials from sliding out from the open ends of the binding wrapper 10 when the binding wrapper 10 is in its closed position.

In this manner, the binding wrapper 10 of the present invention may be used to store a variety of loose materials. For example, in school usage, a single binding wrapper may be used for storing a plurality of materials (i.e., textbook, notebook, and folder) for a single subject (i.e., English, math, history, etc.). A label corresponding to that subject may then be inserted into the label pocket 30 to identify the subject of materials stored by the binding wrapper. The student may use a plurality of binding wrappers, with each binding wrapper binding together or gripping a plurality of materials for a single subject. In other words, each binding wrapper may be dedicated to a single subject. Thus, a student can simply grab the appropriate binding wrapper for the subject of interest, and thereby obtain all of the relevant materials for a subject in a single motion. Of course, a single wrapping binder may also be used to store or bind a plurality of materials for varying subjects.

Having described the invention in detail and by reference to the preferred embodiments, it will be apparent that modifications and variations thereof are possible without departing from the scope of the invention.

What is claimed is:

1. A binding wrapper comprising:

a first generally stiff end component having an inner surface, an outer surface and a portion of hook and loop fastening material located on said first end component;

a second generally stiff end component spaced apart from said first end component and having an inner surface, an outer surface and a portion of hook and loop fastening material located on said second end component, wherein said portions of hook and loop fastening material are releasably attachable together to releasably attach said first and second end components together, and wherein when said binding wrapper is in an opened substantially flat position, both of inner surfaces generally face a first direction and both of said outer surfaces generally face a second direction that is opposite to said first direction; and a connecting component extending between said first and second end components, said connecting component including at least a portion of substantially stretchable elastic material, wherein said first and second end components are releasably attachable together such that said wrapper is formable into a closed loop, and wherein when said wrapper is formed into said closed loop said second end component at least partially overlaps said first end component such that said outer surface of said first end component faces and is substantially parallel to said inner surface of said second end component, and wherein each portion of hook and loop fastening material extends substantially the entire length of the associated end component to allow said first and second end components to be releasably attached together in a variety of overlapping conditions, and wherein at least one of said end components or said connecting component includes a frictional gripping surface on an inner surface thereof to aid in gripping loose materials inside said closed loop when said wrapper is formed into said closed loop.

2. The binding wrapper of claim 1 wherein said first and second end components and said connecting component are generally flat and planar.

3. The wrapper of claim 1 wherein said connecting component includes a generally stiff backing component, a first substantially stretchable elastic component located on one side of said backing component and a second substantially stretchable elastic component located on opposite side of said backing component, and wherein said first end component, said second end component, and said backing component are generally parallel when said wrapper is in said opened substantially flat position and are generally parallel when said wrapper is formed into said closed loop.

4. The wrapper of claim 1 wherein said first portion of hook and loop fastening material is located on said outer surface of said first end component and said second portion of hook and loop fastening material is located on said inner surface of said second end component.

5. The wrapper of claim 1 wherein said frictional gripping surface is a roughened surface.

6. The wrapper of claim 1 including a pocket located on one of said end components.

7. The wrapper of claim 1 wherein each of said first and second end components and said connecting component have substantially the same width.

8. The wrapper of claim 1 wherein each of said first and second end components and said connecting component have a width greater than about 4 inches.

9. The binding wrapper of claim 1 wherein said connecting component includes a front cover of a binder.

10. A binding wrapper comprising:

a generally stiff backing component;

a first generally stiff end component having a portion of fastening material located thereon;

a second generally stiff end component having a portion of fastening material located thereon;

a first substantially stretchable elastic component extending between said backing component and said first end component; and a second substantially stretchable elastic component extending between said backing component and said second end component, wherein said portions of fastening material of said first and second end components are releasably attachable together in a variety of overlapping conditions to form said wrapper into a closed loop and wherein said first and second end components are generally parallel when said wrapper is formed into said closed loop.

11. The binding wrapper of claim 10 wherein said backing component includes at least a portion of a cover of a binder.

12. The binding mechanism of claim 10 wherein said first and second end components are stiffer than said elastic components.

13. The binding wrapper of claim 10 wherein said first end component, said second end component, and said backing component are positionable such that they are generally parallel when said wrapper is formed into said closed loop.

14. The binding wrapper of claim 10 wherein said elastic material of said connecting components is significantly elastically deformable such that said binding wrapper is expandable to accommodate various sizes of loose materials to be bound therein.

15. The binding wrapper of claim 10 wherein said portion of fastening material of said first end component is entirely located on said first end component, and said portion of fastening material of said second end component is entirely located on said second end component.

16. The binding wrapper of claim 10 wherein said portion of fastening material of said first end component is located on an outer surface of said first end component and said portion of fastening material of said second end component is located on an inner surface of said second end component.

17. The binding wrapper of claim 10 wherein each portion of fastening material extends substantially the entire length of the associated end component to allow said first and second end components to be coupled together in a variety of overlapping conditions.

18. The binding wrapper of claim 10 wherein at least one of said first end component, said second end component, said first elastic component, or said second end component has a width of about 6 inches.

19. The binding wrapper of claim 10 wherein said binding wrapper has a width of about 6 inches.

20. The binding wrapper of claim 10 wherein each portion of fastening material is hook and loop fastening material.

21. The binding wrapper of claim 10 wherein said binding wrapper has a length direction extending from one end component to the other end component when said binding wrapper is in an opened substantially flat position, and wherein each end component has a length extending in said length direction that is less than a length of said backing component extending in said length direction.

22. A binding wrapper comprising:

a generally stiff backing component;

a first generally stiff end component;

a second generally stiff end component;

a first substantially stretchable elastic component extending between a first side of said backing component and said first end component;

a second substantially stretchable elastic component to extending between a second side of said backing component and said second end component;

a first portion of hook and loop fastening material directly or indirectly coupled to said first elastic component; and a second portion of hook and loop fastening material directly or indirectly coupled to said second elastic component, wherein said first and second portions of hook and loop materials are releasably attachable together in a variety of overlapping conditions such that said wrapper is formable into a closed loop, and wherein at least one of said first end component, said second end component, said first elastic component, or said second end component has a width of about 6 inches.

23. The binding wrapper of claim 22 wherein said backing component includes at least a portion of a cover of a binder.

24. The binding wrapper of claim 22 wherein said backing component is stiffer than said first and second elastic components.

* * * * *

UNITED STATES PATENT AND TRADEMARK OFFICE

CERTIFICATE OF CORRECTION

PATENT NO. : 7,165,788 B2
APPLICATION NO. : 10/455923
DATED : January 23, 2007
INVENTOR(S) : Christopher M. Smith et al.

It is certified that error appears in the above-identified patent and that said Letters Patent is hereby corrected as shown below:

Column 6

Line 43, delete "to" at the end of the line.

Signed and Sealed this

Third Day of April, 2007

JON W. DUDAS
*Director of the United States Patent and Trademark Office*